United States Patent [19]

Parker et al.

[11] 4,095,883

[45] Jun. 20, 1978

[54] MAGNETIC MIXING APPARATUS AND PROCESS

[75] Inventors: Delmer G. Parker, Rochester; Robert D. Bonham, Ontario, both of N.Y.

[73] Assignee: Xerox Corporation, Stamford, Conn.

[21] Appl. No.: 654,501

[22] Filed: Feb. 2, 1976

[51] Int. Cl.[2] ..... G03G 15/00; B05B 5/02

[52] U.S. Cl. ..... 355/3 DD; 96/1 SD; 118/657; 118/658; 222/DIG. 1; 427/18

[58] Field of Search ..... 355/3 R, 3 DD, 14; 118/652, 655, 656, 657, 658; 222/DIG. 1; 427/18, 19; 96/1 SD

[56] References Cited

U.S. PATENT DOCUMENTS

| | | | |
|---|---|---|---|
| 3,707,947 | 1/1973 | Reichart | 118/658 |
| 3,712,266 | 1/1973 | Stauffer | 222/DIG. 1 X |
| 3,893,414 | 7/1975 | Hudson | 355/3 DD X |
| 3,915,121 | 10/1975 | Wilcox | 118/658 |
| 3,916,830 | 11/1975 | Kojima et al. | 118/203 X |
| 3,943,887 | 3/1976 | Smith | 118/658 X |
| 3,953,121 | 4/1976 | Reichart | 118/658 X |

FOREIGN PATENT DOCUMENTS

| | | | |
|---|---|---|---|
| 2,257,030 | 6/1973 | Germany | 355/3 DD |

*Primary Examiner*—Fred L. Braun

*Attorney, Agent, or Firm*—James J. Ralabate; Clarence A. Green; Paul Weinstein

[57] ABSTRACT

A magnetic mixing apparatus and process for mixing magnetizable developer material for use in the development system of an electrostatographic reproducing machine. In accordance with one embodiment a blanket of developer material is magnetically divided into a plurality of widely spaced apart streams. In accordance with an alternative embodiment, the blanket of developer material is magnetically divided into a plurality of closely adjacent or touching streams having different trajectories. Preferably the streams are then directed into one or more cross-mixing devices to provide enhanced side-to-side mixing of the developer.

30 Claims, 8 Drawing Figures

FIG. 5
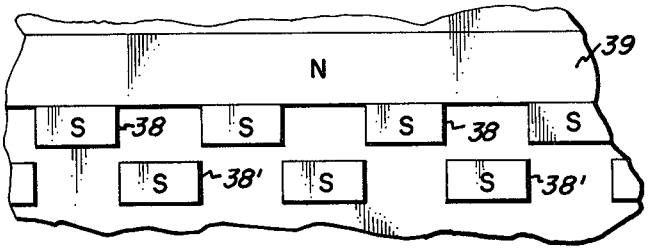
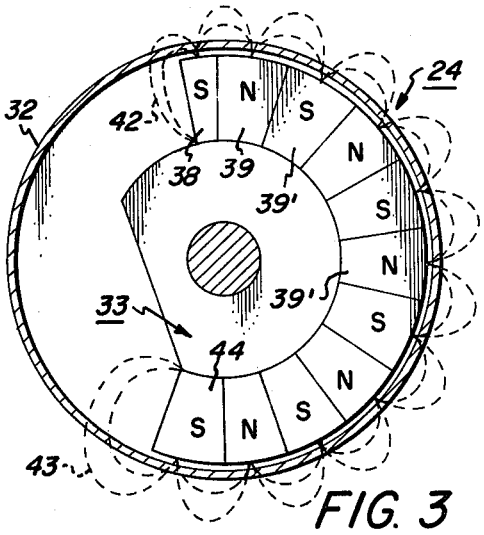
FIG. 3
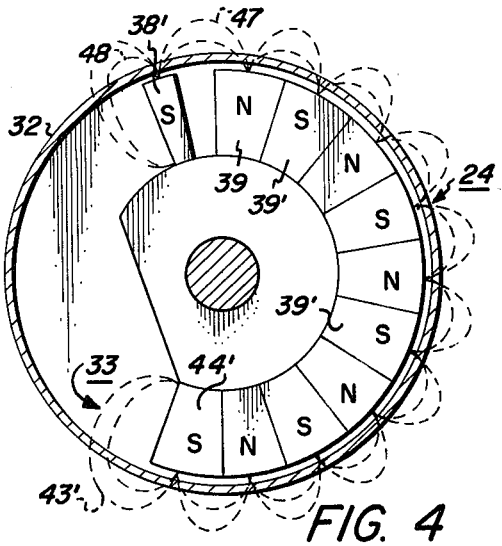
FIG. 4
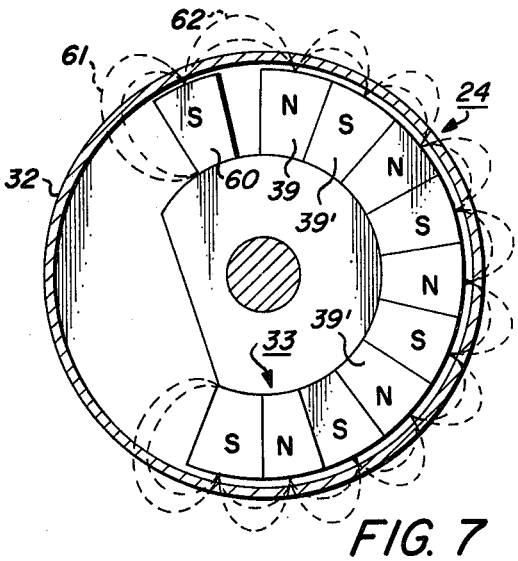
FIG. 7
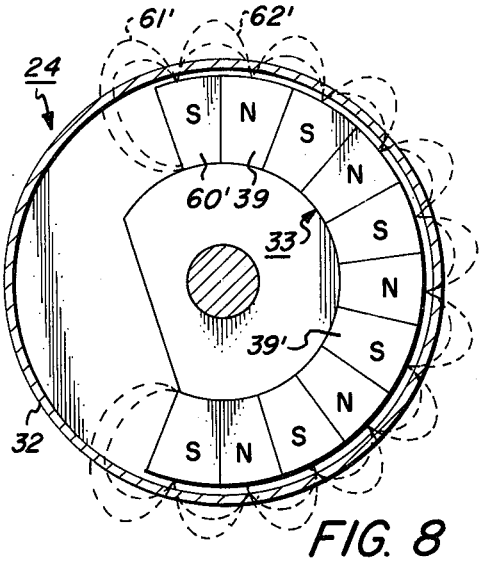
FIG. 8

MAGNETIC MIXING APPARATUS AND PROCESS

BACKGROUND OF THE INVENTION

This invention relates to a mixing apparatus for mixing a magnetizable developer material for use in developing images on an image recording surface. The mixing apparatus in accordance with this invention is particularly adapted for use in magnetic brush development systems utilized in reproducing machines.

Magnetic brush development systems have found wide commercial application in xerographic type reproducing machines. Such developer systems utilize a magnetizable developer mix comprised of relatively coarse magnetizable carrier particles and extremely fine colored toner particles. The triboelectric relationship between the carrier particles and the toner particles is such that upon mixing the toner particles adhere electrostatically to the carrier particles. The developer mix is normally applied to the image recording surface by means of a magnetic development roll.

A recognized problem with this type of development system is the tendency for localized toner depletion to occur due to the development of non-uniform images. For example, the development of high density images at a given axial location of the roll causes toner depletion and loss of density for further images. To remedy this problem the prior art has suggested the use of a variety of cross-mixing devices including chutes, baffles and augers. In U.S. Pat. Nos. 3,707,947 to Reichart; 3,697,050 to Stanley; and 3,572,289 to Maksymiak, variously oriented chutes or baffles re-distribute the developer in an axial sense.

A wide variety of magnet arrangements have been utilized for magnetic brush development rolls. U.S. Pat. Nos. 3,543,720 to Drexler and 3,654,902 to Hakanson are illustrative of magnetic brush development roll designs wherein magnetic poles are alternated circumferentially of the roll. This results as described in Hakanson in alternating normal and tangential fields which disrupt and reform the magnetic brush on the roll surface. It is stated that this creates inter-mixing and circulation of the toner mix to allow excess toner in certain portions of the brush to be worked into adjacent areas to equalize the amount of toner along the axial length of the brush. The magnet arrangement of the foregoing patents produces substantially uniform fields axially of the development roll and non-uniform fields circumferentially of the development roll.

In another approach alternate magnetic poles are arranged axially of the magnetic roll to provide non-uniform fields axially of the roll and substantially uniform fields circumferentially of the roll. Illustrative of this approach is U.S. Pat. No. 3,003,462.

Other approaches to providing non-uniform fields axially of the development roll are described, for example, in German Pat. No. 1,218,287 to Kramskins and in U.S. Pat. Nos. 2,846,333 to Wilson; 2,854,947 to Gramo; and 3,196,831 to Sugarman. These patents show the use of a number of different structures for passing magnetic developer along helical or other non-circular paths on a magnetic brush roll.

Magnets have also been used in conjunction with magnetic brush development rolls for controlling the flow of developer material on the roll. For example, in U.S. Pat. No. 3,754,526 to Caudill the use of a pick-up magnet which is shorter in an axial sense than the development magnet causes the developer material to move inwardly of the ends of the roll. Alternatively, two magnet segments inset from the ends of the roll are utilized in place of the shortened single magnet. Likewise, in U.S. Pat. No. 3,648,656 to Ogawa magnetic field generating means are utilized to prevent developer from being picked up on the ends of the development roll. Another example of the use of magnetic field generating devices for controlling the axial width of the developer blanket on the magnetic brush roll is set forth in U.S. Patent application Ser. No. 510,939, filed Oct. 1, 1974, to Hudson. In U.S. Pat. No. 3,915,121, to Wilcox, magnets are used to provide flow baffles for trimming a moving magnetic brush of developer material.

SUMMARY OF THE INVENTION

In accordance with the present invention a mixing apparatus is provided for mixing a magnetizable developer material for use in developing images on an image-recording surface. A reproducing apparatus utilizing the mixing apparatus also forms a part of the present invention. In accordance with this invention it is desired to provide improved inter-mixing of the developer material from side-to-side of the development system.

In accordance with one embodiment the mixing apparatus of the present invention includes a means for transporting a blanket of the magnetizable developer material in a desired direction and means for mixing the developer material. The mixing means comprises a first means for magnetically dividing the blanket of developer material into a plurality of adjacent streams of developer. The magnetic dividing means also controls the trajectory of the developer streams so that the trajectory followed by one stream is different from the trajectory followed by another stream and preferably different from a stream next adjacent to the one stream.

Plural cross-mixing devices are preferably utilized in this embodiment such that one cross-mixing device receives streams of one trajectory and another cross-mixing device receives streams of the different trajectory. The provision of streams of developer material with alternating trajectories imparts a phase or time delay in developer mixing.

In accordance with an alternative embodiment the mixing apparatus includes a means for magnetically dividing the blanket of developer material into a plurality of discrete streams of developer material which are spaced apart from one another in a direction transverse to the direction from which the developer material is moving. The magnetic dividing means imparts a certain amount of rotation and axial movement of the developer mix as it draws developer material from either side and coalesces it into a stream.

Preferably, the separated streams of developer material of this embodiment are then passed through a cross-mixing device to provide side-to-side mixing. Preferably, a means is provided for magnetically forming a substantially uniform blanket of developer material upstream of the magnetic dividing means.

Accordingly, it is an object of the present invention to provide an improved apparatus and process for mixing a magnetizable developer material for use in developing images on an image-recording surface.

It is a further object of this invention to provide an apparatus and process as above including magnetic intermixing the developer material.

It is a still further object of this invention to provide a reproducing apparatus and process employing the above-described mixing apparatus and process.

These and other objects will become more apparent from the following description and drawings.

BRIEF DESCRIPTION OF THE DRAWINGS

FIG. 3 is a cross-sectional view of the development roll of the apparatus in FIG. 2.

FIG. 4 is a cross-sectional view of a development roll in accordance with an alternative embodiment for use in the apparatus as in FIG. 2.

FIG. 5 is a partially cut-away top view of a roll magnet combining the effects of the rolls of FIGS. 3 and 4.

FIG. 7 is a cross-sectional view of the development roll in FIG. 6.

FIG. 8 is a cross-sectional view of an alternative development roll which could be used in the apparatus of FIG. 6.

DETAILED DESCRIPTION OF THE PREFERRED EMBODIMENTS

Figure 1:
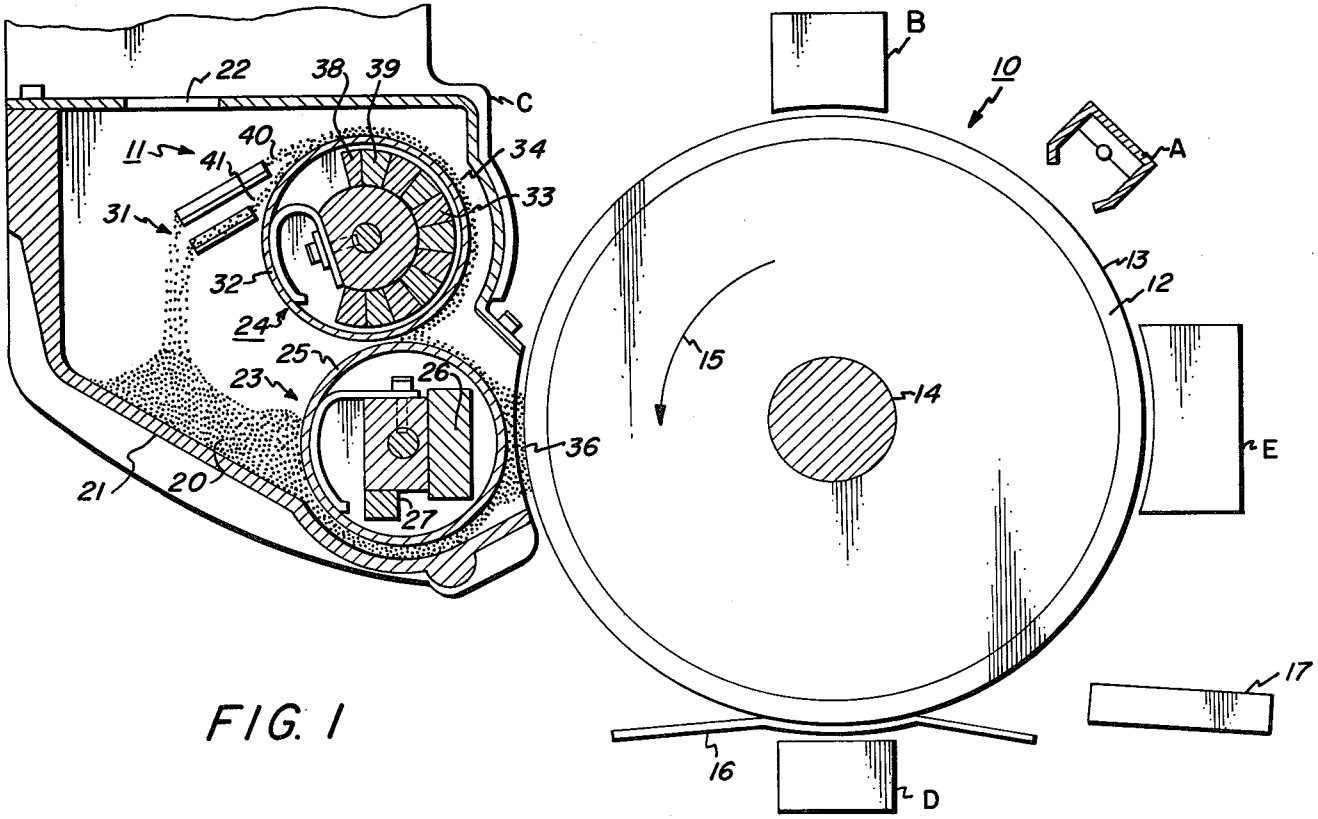
FIG. 1 is a schematic representation of a reproducing apparatus in accordance with the present invention showing the development system of this invention in partial cross-section.

Referring now to FIG. 1 there is shown by way of example an automatic xerographic reproducing machine 10 which incorporates the magnetic mixing apparatus 11 of the present invention. The reproducing machine 10 depicted in FIG. 1 illustrates the various components utilized therein for producing copies from an original. Although the magnetic mixing apparatus 11 of the present invention are particularly well adapted for use in an automatic xerographic reproducing machine 10, it should become evident from the following description that they are equally well suited for use in a wide variety of processing systems including other electrostatographic systems and they are not necessarily limited in their application to the particular embodiment or embodiments shown herein.

The reproducing machine 10 illustrated in FIG. 1 employs an image recording drum-like member 12, the outer periphery of which is coated with a suitable photoconductive material 13. One type of suitable photoconductive material is disclosed in U.S. Pat. No. 2,970,906, issued to Bixby in 1961. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

The practice of xerography is well known in the art and is the subject of numerous patents and texts including *Electrophotography* by Schaffert, published in 1965, and *Xerography and Related Processes* by Dessauer and Clark, published in 1965.

The various processing stations for producing a copy of an original are herein represented in FIG. 1 as blocks A to E. Initially, the drum 12 moves the photoconductive surface 13 through a charging station A. In the charging station A, an electrostatic charge is placed uniformly over the photoconductive surface 13 preparatory to imaging. The charging may be provided by a corona generating device of the type described in U.S. Pat. No. 2,836,725, issued to Vyverberg in 1958.

Thereafter, the drum 12 is rotated to exposure station B wherein the charged photoconductive surface 13 is exposed to a light image of the original input scene information whereby the charge is selectively dissipated in the light exposed regions to record the original input scene in the form of a latent electrostatic image. A suitable exposure system may be of a type described in U.S. Pat. No. 3,832,057 issued to Shogren in 1974. After exposure drum 12 rotates the electrostatic latent image recorded on the photoconductive surface 13 to development station C in accordance with the invention wherein a conventional developer mix is applied to the photoconductive surface 13 of the drum 12 rendering the latent image visible. A suitable development station is disclosed in U.S. Pat. No. 3,707,947, issued to Reichart in 1973. That patent describes a magnetic brush development system utilizing a magnetizable developer mix having coarse ferromagnetic carrier granules and toner colorant particles. The developer mix is brought through a directional flux field to form a brush thereof. The electrostatic latent image recorded on the photoconductive surface 13 is developed by bringing the brush of developer mix into contact therewith.

Further details of the development apparatus which comprises development station C will be described later by specific reference to the present invention.

The developed image on the photoconductive surface 13 is then brought into contact with the sheet 16 of final support material within a transfer station D and the toner image is transferred from the photoconductive surface 13 to the contacting side of the final support sheet 16. The final support material may be paper, plastic, etc., as desired.

After the toner image has been transferred to the sheet of final support material 16 the sheet with the image thereon is advanced to a suitable fuser 17 which coalesces the transferred powder image thereto. One type of suitable fuser is described in U.S. Pat. No. 2,701,765, issued to Codichini et al. in 1955. After the fusing process the sheet 16 is advanced to a suitable output device.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station E. The toner particles may be mechanically cleaned from the photoconductive surface 13 by any conventional means as, for example, the use of a blade as set forth in U.S. Pat. No. 3,740,789, issued to Ticknor in 1973.

It is believed that the foregoing description is sufficient for purposes of the present application to illustrate the general operation of an automatic xerographic copier 10 which can embody the magnetic mixing apparatus 11 in accordance with the present invention.

Referring again to the development apparatus C it includes a storage portion or sump 20 in a housing 21 for storing the developer material. The top of the housing may include an opening 22 that could have a removable cover or cap (not shown). The system could include a toner dispenser (not shown) disposed over the opening which periodically dispenses toner into the housing in a manner similar to that taught in U.S. Pat. No. 3,608,792. Alternatively, the circulating system could be of the type where toner and/or toner plus carrier is added periodically by an operator or an attendant to the machine.

The development apparatus C includes magnetic brush rolls 23 and 24. The magnetic brush applicator roll 23 includes a rotatably mounted support member in the form of a cylindrical shell or sleeve 25 and a stationary permanent magnet 26 suspended within the sleeve. The magnetic field of the magnet is oriented to form a brush-like structure of the developer mix. The applicator roll 23 is immersed in the sump 20 of developer material which comprises ferromagnetic carrier particles and toner colorant particles. The developer mix is picked up in a blanket-like configuration by the outer support surface of the roll 23 by means of a pick-up magnetic field generated by stationary magnet 27 suspended within the sleeve 25, and is formed into a brush-like structure for application to the photoconductive surface 13 by magnet 26 for development of the latent electrostatic image presented thereon. While only one applicator roll 25 is shown, any number of applicator rolls could be employed as desired. The applicator roll 23 need not be immersed in a sump 20 of developer since other means for supplying developer to the roll could be employed as, for example, transport rolls and other types of conveying systems.

A magnetic mixing apparatus 11 in the embodiment which will be described is shown in conjunction with the lifting or transport magnetic brush roll 24. The magnetic mixing apparatus 11 of this invention can be employed at a variety of locations in a magnetic brush development apparatus C. Similarly, it could be employed in systems where magnetic developer material is circulated between the development system and another system such as cleaning station E. For example, it could be located within the cleaning system.

Preferably, the mixing apparatus 11 is located so that it can act upon the developer mix after it has passed through the development zone 36 and prior to its reapplication at the development zone. Therefore, it could be located in a lifting type transport roll 24 as shown or it could be associated with other types of transport devices for transporting developer to a development roll 23. Further, it is possible, in accordance with this invention, to utilize various of the magnetic mixing concepts in conjunction with a development roll 23 or rolls.

This invention is particularly directed toward providing improved mixing of the developer material so as to reduce the effects of localized toner depletion as described in the background of the invention. This problem is particularly acute in compact magnetic brush development systems C which are utilized for compact reproducing machines such as desk top copiers.

In the above-noted patent to Hakanson, a magnetic brush roll arrangement is utilized for transport and development wherein alternating magnetic poles are disposed circumferentially of the rolls. It is alleged in this patent that this will result in inter-mixing so that the toner can be worked into adjacent areas of the roll to equalize the amount of toner along the length of the brush. It is not apparent how alternating magnetic poles disposed circumferentially of the rolls provide an inter-mixing action axially thereof.

In accordance with the present invention, it is desired to provide enhanced inter-mixing of the developer mix. In accordance with one embodiment of this invention the magnetic mixing means magnetically divides a blanket of developer material into a plurality of adjacent streams of development material and magnetically controls the trajectory of those streams of developer so that the trajectory followed by one stream is different from the trajectory followed by another of the streams. Preferably the trajectory of one stream is different from the trajectory followed by a stream next adjacent to the one stream. This difference in trajectory imparts a phase or time delay type of mixing to the developer mix since the developer in one stream will return to the sump sooner than the developer in another stream depending on the relative trajectories.

It is preferred that this magnetic mixing approach be combined with plural cross-mixing devices which act on different streams depending upon their trajectory. This provides a unique combination of developer inter-mixing since it provides both conventional cross-mixing as well as time delay mixing.

In accordance with an alternative embodiment a blanket of developer mix which is being transported is magnetically divided into a plurality of discrete and widely separated streams. Using this approach a certain amount of rotation of the developer mix occurs in an axial sense as the developer material is drawn from either side of the stream and coalesced into the stream. The plurality of discrete streams may then be applied to a conventional cross-mixing device in order to obtain further axial movement of the developer material.

Figure 2:
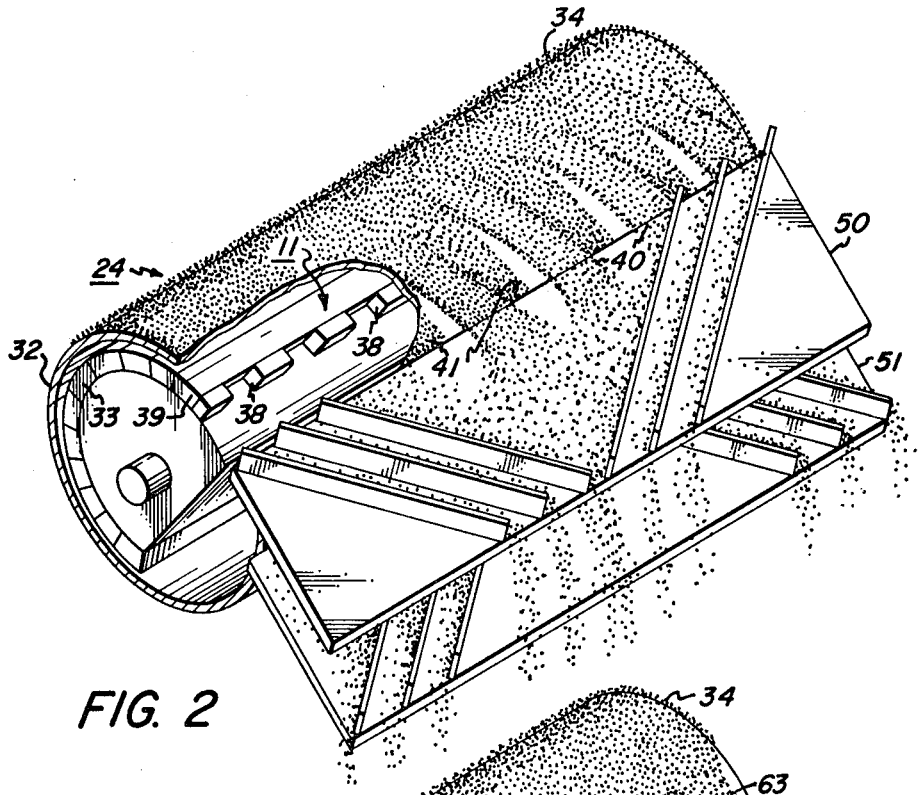
FIG. 2 is a partially cut-away perspective view of a mixing apparatus in accordance with one embodiment of the present invention.

Referring now to FIGS. 1 and 2, an apparatus 11 in accordance with the first embodiment of the present invention is shown in greater detail. In this embodiment the magnetic mixing apparatus 11 has been incorporated in the magnetic brush lifting or transport roll 24. The transport roll 24 utilizes as aforenoted a multi-pole permanent magnet 33 to generate a magnetic field which causes the developer mix to adhere to the moving roll surface 32 in a blanket-like configuration. This results in non-uniform magnetic fields circumferentially of the roll 24 and substantially uniform magnetic fields axially of the roll except for fringe field effects at the ends of the magnet. The use of such a multipole configuration will result in a mixing of the type described in the above-noted Hakanson patent due to the alternating presence of normal and tangential type magnetic fields as the roll surface 32 travels past the respective magnetic poles.

The mixing means 11 divides the blanket of developer material 34 into a plurality of adjacent streams of developer material and controls the trajectories of each of the streams so that the trajectory of one stream is different from the trajectory of another stream and preferably a stream next adjacent to it. This is accomplished by providing an additional magnet pole 38 following the last pole 39 of the transport roll magnet 33. The additional magnet pole is foreshortened in a circumferential sense in comparison to the magnetic poles 39 of the magnet 33. Further, unlike the regular poles 39 and 39' which extend axially from end to end of the roll 24, the additional magnet pole 38 comprises magnet segments which are spaced apart axially on the roll 24. Thus, while the last pole 39 of the transport roll magnet provides a uniform field axially of the roll the additional magnetic pole segments 38 provide a non-uniform field axially of the roll. The non-uniform field provides alternating high and low magnetic force regions axially of the roll 24 corresponding to the presence or absence of magnet pole segments 38. The effect of this non-uniform magnetic field is to divide the developer blanket 34 into a plurality of streams 40 and 41.

Where the additional magnetic pole segments 38 are positioned closely adjacent or in contact with the last pole 39 of the transport roll magnet 33 they have been found to behave in the manner of a shunt. Referring to FIG. 3 the shunt effect of the additional magnet segments 38 results in a magnetic fringe field 42 in line with those segments which is foreshortened in comparison to the fringe field between segments 38 which is associated with the last pole 39 of the magnet 33. In the figure, the fringe field 43 associated with the first pole 44 of the magnet 33 is representative of the extent of the fringe field associated with the last pole 39 for purposes of comparison. Alternatively, other forms of shunt segments using highly permeable materials such as steel could be employed in place of magnet segments 38.

The circumferential extent of the magnetic fields and the magnet forces associated with them are greater in the regions between pole segments 38 than in regions in line with those segments. Therefore, one would anticipate with the embodiment of FIG. 3 that the streams 40 with the highest trajectory, namely, the streams which are first released from the roll surface 32 would be those in line with the dividing magnet segments. The streams of lower trajectory 41 would be in line with the regions between the dividing magnet segments.

On the other hand, if the dividing magnet segments 38' (FIG. 5) are located spaced from the last pole 39 of the magnet 33, the opposite effect results. The magnetic field 47 coupled between the last pole 39 of the magnet 33 and the magnet segments 38' and the fringe fields 48 of the segments will provide regions of high magnetic force with greater circumferential extent and, therefore, hold the developer stream in line with the segments on the roll surface 32 for a longer time. The magnetic forces associated with the fringe field of the last magnetic pole 39' (similar to field 43' of the first pole 44'), will be of lesser circumferential extent in the regions between magnet segments 38'. Therefore, in accordance with the embodiment of FIG. 4, the developer streams 40 with highest trajectory will be those in line between magnet segments 38' and the developer streams 41 with the lowest trajectory will be those formed in line with the magnet segments.

In a particularly preferred design in accordance with this embodiment of the invention a combination of the magnet segment arrangements shown in FIGS. 3 and 4 are combined into an arrangement as depicted in FIG. 5 to provide even greater separation between the trajectories of adjacent streams 40 and 41. In this approach shunt type dividing magnet segments 38 are positioned against the last pole 39 and magnet segments 38' are spaced from the former in an axial sense so they are positioned axially between the shunt type segments. The shunt type segments 38 provide a sharp drop-off in the magnetic forces associated with the last pole 39 of the magnet 33 whereas the magnet segments 38' spaced from the last pole 39 provide strong magnetic forces over a greater circumferential extent. This accentuates the difference in the time durations that the magnetic forces are applied to the adjacent streams 40 and 41 of developer as compared to the approaches of FIGS. 3 and 4 above and thereby provides an accentuated difference in the trajectories in those streams.

The actual magnet structure used for accomplishing the magnetic dividing of the developer blanket 34 and trajectory control may be of any desired design. The approaches described above can be employed. However, it is believed that other approaches could be readily devised for magnetically dividing a blanket 34 of developer mix into a plurality of streams of different trajectories. All such approaches are intended to be encompassed in accordance with the present invention.

For example, in the approaches thus far described, the segments 38 and 38' have been designated in the Figures to be of opposite polarity to the last pole 39. If desired, however, the segments 38 and 38' could be of the same polarity. For example, a segment 38 of like polarity positioned against pole 39 would provide a relatively short low magnetic force region and extend or lengthen the fringe field 42. A segment 38' of like polarity spaced from pole 39 would provide a longer circumferential region of low magnetic force. Therefore, the use of segments 38 and 38' of the same polarity as last pole 39 would provide the opposite effects on the trajectories of the streams 40 and 41 as compared to the effects described above for segments 38 and 38' which are of opposite polarity to the last pole 39. Therefore, it should be apparent that the magnet arrangement is susceptible of wide variation while still accomplishing the functions of this invention.

The different trajectories provided by the magnetic mixing apparatus 11 of this embodiment permit the use of plural cross-mixing devices 50 and 51. The cross-mixing devices may be of any conventional design and may comprise vanes, chutes, baffles, augers, etc. Vaned type cross-mixers 50 and 51 are shown for purposes of example. In the arrangement shown streams 40 and 41 with two alternating and different trajectories could be provided by suitably positioning magnet segments 38 and 38' in association with the surface 32.

Since only two trajectories are shown, only two cross-mixing devices 50 and 51 are employed. The first cross-mixing device 50 is arranged to receive the developer streams 40 with the high trajectory and the second cross-mixing device 51 is arranged to receive the developer streams 41 with the low trajectory. The cross-mixing devices 50 and 51 may be adjusted independently of one another to correct for asymmetric developer distribution problems.

Since the developer blanket 34 has been divided into alternate streams with different trajectories, it is apparent that there will be a mixing effect resulting from the differences in the time it takes for the developer in one stream 40 versus the developer in another stream to return to the sump 20. This may be classed as a time delay or phase delay type of inter-mixing. The use of cross-mixers 50 and 51 in addition to this phase or time delay type of inter-mixing of the developer mix provides a unique and improved cross-mixing apparatus. It is not essential, however, in accordance with this invention that the magnetic mixing apparatus 11 be utilized in conjunction with cross-mixing devices 50 and 51.

Figure 6:
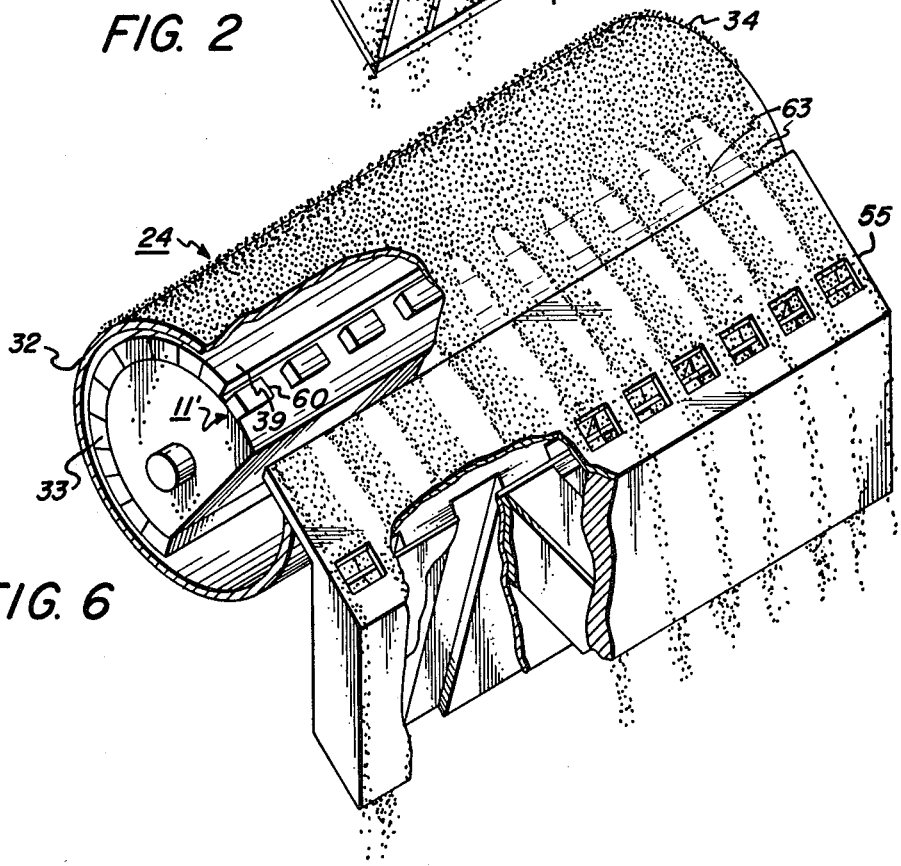
FIG. 6 is a partially cut-away perspective view of a mixing apparatus in accordance with another embodiment of the present invention.

Referring now to FIGS. 6–8, an alternative embodiment of the invention includes a magnetic mixing apparatus 11' which is effective to provide axial movement and mixing of the developer. Like elements have been given the same reference number as in the embodiment of FIGS. 1–5. This embodiment can be used in conjunction with a cross-mixing device 55 to provide further cross-mixing of the developer material for reducing localized toner depletion effects.

Referring to FIG. 6, the magnetic mixing apparatus 11' is shown to comprise axially spaced apart dividing magnet segments 60 spaced circumferentially from the last pole 39 of the transport roll magnet 33. They provide a substantially non-uniform field axially of the roll. These magnet segments 60 are substantially longer in a circumferential sense than the segments 38 in the previous embodiment. Therefore, the time duration during which the blanket 34 of developer material is acted upon by the magnetic fields 61 and 62 associated with these magnet segments is substantially greater than that associated with the previous embodiment. Therefore, developer material in the regions in line between the added magnet segments 60 is caused to move axially on the roll surface 32 so that the developer blanket is divided into a plurality of widely spaced apart streams 63 of developer material. Each stream 63 is comprised of developer material from the area of the steam as well as developer material from areas adjacent to the stream which have been coalesced into the stream.

In the embodiment shown in FIG. 6, the magnet segments 60 are positioned spaced from the last pole 39, however, magnet segments 60' could be positioned closely adjacent or in contact with the last pole of the transport magnet 33, as in FIG. 8. The magnet segments 60' have a sufficient length in a circumferential sense that they do not act as a shunt as in the previous embodiment. Instead they act as an additional magnet pole.

The magnet segments 60 which are spaced from the last pole 39 provide magnetic fields 61 and 62 of greater circumferential extent than the fields 61' and 62' associated with the segments 60' and, therefore, they are preferred. However, if the segments 60' have a sufficient circumferential extent as shown, they are fully effective for dividing the developer blanket into a plurality of separated streams. Preferably, in accordance with this embodiment the separate streams 63 of material which have now been mixed in an axially sense are fed through an appropriate cross-mixing device 65. For example, a chuted cross-mixer, which is similar in most respects to that described in above-noted Reichart patent will further enhance the axial inter-mixing of the developer material.

As in the case of the previous embodiment, it is not intended to limit the specific magnetic structure utilized for providing the magnetic mixing means 11' to the structure shown since a variety of other magnet arrangements could be utilized to obtain the same results. Similarly, as in the case of the previous embodiment, the invention as described in this embodiment is not limited to the use solely of opposite poles for the last magnet pole 39 and the additional magnet segments 60.

The embodiments of this invention described above are similar in that the developer blanket 34 as it proceeds circumferentially on the roll surface 32 is first acted upon by magnetic fields which are substantially uniform in an axial sense and then by magnetic fields which are non-uniform or undulating in an axial sense. The axially uniform fields provide the blanket-like 34 arrangement of the developer mix. The axially non-uniform fields serve to divide the blanket 34 into a plurality of streams. Both of the embodiments described above utilize axially spaced apart additional magnet segments 38 or 60 following the last pole 39 of the transport magnet 33 for producing the axially non-uniform fields. In one embodiment the streams are widely separated, whereas in the other embodiment they are closely adjacent or even touching, however, their trajectories are widely divergent. This substantial difference in operation is a function of many variables in the system described.

As above-noted the developer mix preferably comprises magnetizable carrier particles and toner colorant particles. The carrier particles generally are comprised of a polymer coated steel shot. As the carrier particles are released from magnetic entrainment upon the roll surface, they act as projectiles and the path which they will travel is governed by conventional laws of physics.

In accordance with the present invention the following parameters would be expected to affect the kind of operation provided by a magnet structure as described in accordance with the above-noted embodiments. The principal factor which will determine whether or not one obtains alternating streams of varying trajectory or widely separated streams of developer mix is the time interval during which the developer blanket 34 is acted upon by the magnetic forces associated with the segments 38, etc., to entrain it upon the roll surface. The magnetic force is a function of the magnetic field and the magnetic field gradient. The radial or normal magnetic field strength associated with the short segments should be substantially lower than the radial field strength associated with the longer segments. The greater the circumferential extent of the magnetic forces, the greater will be the duration of their influence upon the developer mix and the tendency of the developer blanket to be divided into plural spaced apart streams. Contrawise, the shorter the circumferential extent of the magnetic forces entraining the developer mix on the roll surface, the greater will be the tendency for the developer blanket to be divided into a plurality of closely adjacent streams of differing trajectory.

The velocity of the roll surface affects both the time duration of the influence of the magnetic forces and the trajectory of the developer material as it leaves the roll surface. The position about the roll surface at which the developer material is released therefrom also will have a substantial bearing on the trajectory. Therefore, release of the high trajectory streams 40 near the twelve o'clock position is preferred. The diameter of the roll will also influence the relative trajectories of the streams.

It is not possible to difinitively set limits for these parameters because of the inter-action of all of them. Having thus described alternative embodiments of magnet re-mixing apparatuses 11 and 11' in accordance with the present invention, the following examples are intended to illustrate specific systems which it is believed would operate in the desired manner.

EXAMPLE I

Carrier: 100 micron diameter steel methylterpolymer coated shot.

Magnet material: Koroseal comprising an elastomer matrix impregnated with barium ferrite.

Toner: Xerox 3100 dry imager.

Roll diameter: 1½ inches.

Peripheral roll velocity: 18 inches per second.

Circumferential length between the center of pole 39 and the center of pole 39': approximately ½ inch.

Circumferential length between the center of pole 39 and the center of pole 38: approximately ⅜ inch.

Pole 38 is positioned against pole 39.

Axial distance between magnet segments 38: approximately $\frac{3}{8}$ inch.
Axial width of segments 38: approximately $\frac{3}{8}$ inch.
Circumferential length of segments 38: approximately $\frac{1}{4}$ inch.
Radial magnetic field strength at 0.080 inches from the surface of the magnet: for pole 39 – 450 gauss; for pole 38 – 225 gauss.
Tangential magnetic field strength at 0.080 inches from the surface of the magnet: between poles 38 and 39 – 350 peak gauss. beyond pole 38 – 260 peak gauss.

It is believed that an apparatus 11 in accordance with the present invention constructured in accordance with the above parameters should provide operation in accordance with the embodiment of FIGS. 2 and 3 of this invention wherein alternating streams of developer are divided from the developer blanket and are provided with varying trajectories.

EXAMPLE II

Carrier: 100 micron diameter steel methylterpolymer coated shot
Magnet material: Koroseal, comprising an elastomer matrix impregnated with barium ferrite.
Toner: Xerox 3100 dry imager.
Roll diameter: $1\frac{1}{2}$ inches.
Peripheral roll velocity: 18 inches per second.
Circumferential length between the center of pole 39 and the center of pole 39': approximately $\frac{1}{2}$ inch.
Circumferential length between the center of pole 39 and the center of pole 60: approximately $\frac{5}{8}$ inch.
Pole 60 positioned approximately $\frac{1}{8}$ inch circumferentially spaced from pole 39.
Axial distance between magnet segments 60: approximately 9/16 inch.
Axial width of segments 60: approximately $\frac{3}{8}$ inch.
Circumferential length of segments 60: approximately $\frac{1}{2}$ inch.
Radial magnetic field strength at 0.080 inches from the surface of the magnet: for pole 39 – 450 gauss; for pole 60 – 450 gauss. Tangential magnetic field strength at 0.080 inches from the surface of the magnet: between poles 60 and 39 – 350 peak gauss. beyond pole 60 – 225 peak gauss.

It is believed that an apparatus 11' in accordance with the present invention constructed in accordance with the above parameters should provide operation in accordance with the second embodiment of this invention as in FIGS. 6 and 7, wherein the developer blanket is divided into a plurality of widely separated streams 63.

Referring to Examples I and II, it is apparent that the variation in operation in accordance with this invention can be principally a function of the circumferential extent of the magnetic forces and the magnitude of the magnetic forces.

The magnet structures in accordance with the present invention can be formed by any desired well known process. The magnetic poles 38, 39, and 39' can be formed by selectively magnetizing or impressing those poles or pole segments into a one-piece magnet. Alternatively, the poles can be assembled utilizing separate magnet sections. Further, it is possible in accordance with this invention to use a combination of these approaches, for example, one wherein the magnet 13 comprises a single piece magnet with impressed poles and the segments 38 or 60 comprise additional magnet segments.

The term "non-uniform fields" as used herein is intended to mean fields having a substantial variation in field strength and preferably fields of an undulating nature. The terms "circumferential extent" or "circumferential sense" refer to measurements in the direction of rotation. The terms "axial extent" or "axial sense" as used herein are intended to refer to measurements in a direction parallel to the axis of the roll or a belt pulley if a belt-type development system were utilized.

In summary, in accordance with the present invention, magnetic mixing apparatuses are provided for mixing magnetizable developer material for use in a development system of an electrostatographic reproducing machine. In accordance with one embodiment the mixing apparatus serves to divide a blanket of developer material into a plurality of discrete and widely separated streams, thereby providing enhanced axial mixing of the developer. In accordance with another embodiment the developer blanket is magnetically divided into a plurality of closely adjacent or touching streams having different trajectories. Preferably auxiliary cross-mixing apparatus are provided to enhance the side-to-side mixing of the developer material. The provision of streams with different trajectories allows the use of plural cross-mixers which may be independently adjusted. The use of independently adjustable cross-mixers comprises a substantial improvement in reducing asymmetric distribution of the developer mix in the development system.

The mixing apparatus of this invention can be employed in development or transport rolls or belts as desired.

The patents and texts referred to specifically in this application are intended to be incorporated by reference into the application.

It is apparent that there has been provided in accordance with this invention a magnetic mixing apparatus and process which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a mixing apparatus for mixing a magnetizable developer material for use in developing images on an image recording surface, said apparatus including: means for supporting a blanket of developer material for movement in a desired direction; and means for mixing said developer material; the improvement wherein, said mixing means comprises:

means for magnetically dividing said blanket of developer material into a plurality of adjacent streams of said developer material and for controlling the trajectory of said streams so that the trajectory followed by one stream is different from the trajectory followed by another of said streams;

said magnetic dividing means including first magnetic field generating means for providing a substantially non-uniform magnetic field transversely of said desired direction; and second magnetic field generating means for providing a substantially uniform magnetic field transversely of said desired direction, said second magnetic field generating means being positioned to act upon said blanket of developer material prior to said first magnetic field generating means.

2. An apparatus as in claim 1, wherein said magnetic dividing means controls the trajectory of said streams so that the trajectory followed by one stream is different from the trajectory followed by a stream next adjacent to said one stream.

3. An apparatus as in claim 2, wherein said second magnetic field generating means comprises a first magnetic pole extending transversely of said desired direction from side-to-side of said developer blanket, and wherein said first magnetic field generating means comprises second magnetic pole segments spaced apart from each other, said second magnetic pole segments extending substantially in a first row transversely of said desired direction from side-to-side of said developer blanket.

4. An apparatus as in claim 3, wherein said first magnetic pole and said second magnetic pole segments are of opposite polarity.

5. An apparatus as in claim 3, wherein said first magnetic pole and said second magnetic pole segments are of like polarity.

6. An apparatus as in claim 3, wherein said first magnetic field generating means further includes third magnetic pole segments spaced apart from each other and extending substantially in a second row different from said first row and transversely of said desired direction, said third magnetic pole segments being transversely off-set from said second magnetic pole segments, said second magnetic pole segments being arranged closely adjacent to said first magnetic pole and said third magnetic pole segments being arranged spaced from said first magnetic pole.

7. An apparatus as in claim 3, wherein said second magnetic pole segments are arranged closely adjacent to said first magnetic pole.

8. An apparatus as in claim 3, wherein said second magnetic pole segments are arranged spaced from said first magnetic pole.

9. An apparatus as in claim 3, wherein said means for supporting said blanket of developer material comprises a cylindrical member arranged for rotation, and wherein said first magnetic pole and said second magnetic pole segments are stationarily supported internally of said cylindrical member.

10. An apparatus as in claim 9, further including an electrostatographic reproducing apparatus comprising said image recording surface, means for forming an electrostatic image on said surface, means for developing said electrostatic image with said developer material, and means for transferring said developed image to a sheet of final support material, said mixing apparatus being in operative association with said developing means.

11. A mixing apparatus as in claim 1, further including first cross-mixing means for cross-mixing said magnetizable developer material comprising said one stream; and second cross-mixing means for cross-mixing said magnetizable developer material comprising said another of said streams.

12. An apparatus as in claim 11, wherein said first cross-mixing means is independent of said second cross-mixing means, whereby it is possible to correct for asymmetric developer distribution by adjusting one of said cross-mixing means independently of the other of said cross-mixing means.

13. In a mixing apparatus for mixing a magnetizable developer material for use in developing images on an image recording surface, said apparatus including: means for supporting a blanket of developer material for movement in a desired direction and means for mixing said developer material, the improvement wherein, said mixing means comprises:

means for magnetically dividing said blanket of developer material into a plurality of streams of developer material which are widely spaced apart from each other transversely of said desired direction, said magnetic dividing means comprising:

first magnetic field generating means for generating a substantially uniform magnetic field transversely of said desired direction; and second magnetic field generating means for providing a non-uniform magnetic field transversely of said desired direction, said second magnetic field generating means being arranged to act upon said blanket of developer material after said first magnetic field generating means.

14. An apparatus as in claim 13, wherein said first magnetic field generating means comprises a first magnetic pole extending transversely of said desired direction from side-to-side of said developer blanket, and wherein said second magnetic field generating means comprises second magnetic pole segments spaced apart from each other, said second magnetic pole segments extending substantially in a first row transversely of said desired direction from side-to-side of said developer blanket.

15. An apparatus as in claim 14, wherein said first magnetic pole and said second magnetic pole segments are of opposite polarity.

16. An apparatus as in claim 14, wherein said first magnetic pole and said second magnetic pole segments are of like polarity.

17. An apparatus as in claim 14, wherein said second magnetic field generating means further includes third magnetic pole segments spaced apart from each other and extending substantially in a second row different from said first row and transversely of said desired direction, said third magnetic pole segments being transversely off-set from said second magnetic pole segments, said second magnetic pole segments being arranged closely adjacent to said first magnetic pole and said third magnetic pole segments being arranged spaced from said first magnetic pole.

18. An apparatus as in claim 14, wherein said second magnetic pole segments are arranged closely adjacent to said first magnetic pole.

19. An apparatus as in claim 14, wherein said second magnetic pole segments are arranged spaced from said first magnetic pole.

20. An apparatus as in claim 14, wherein said means for supporting said blanket of developer material comprises a cylindrical member arranged for rotation, and wherein said first magnetic pole and said second magnetic pole segments are stationarily supported internally of said cylindrical member.

21. An apparatus as in claim 14, further including an electrostatographic reproducing apparatus comprising said image recording surface, means for forming an electrostatic image on said surface, means for developing said electrostatic image with said developer material, and means for transferring said developed image to a sheet of final support material, said mixing apparatus being in operative association with said developing means.

22. In a mixing apparatus for mixing a magnetizable developer material for use in developing images on an image recording surface, said apparatus including: an imaging surface arranged for movement in a desired direction; means for supporting a blanket of developer material for movement in a given direction; and means for mixing said developer material, the improvement wherein:

said mixing means comprises means for magnetically dividing said blanket of developer material into a plurality of adjacent streams of developer material arranged one next to the other in a direction transverse to said desired direction of movement of said imaging surface and extending from side-to-side of said imaging surface, and for controlling the trajectory of said stream so that the trajectory followed by one stream is different from the trajectory followed by another of said streams:

said magnetic dividing means including: first magnetic field generating means for providing a substantially non-uniform magnetic field transversely of said desired direction, and second magnetic field generating means for providing a substantially uniform magnetic field trasversely of said desired direction, said second magnetic field generating means being positioned to act upon said blanket of developer material prior to said first magnetic field generating means.

23. An apparatus as in claim 22, wherein said magnetic dividing means controls the trajectory of said streams so that the trajectory followed by one stream is different from the trajectory followed by a stream next adjacent to said one stream.

24. An apparatus as in claim 22, wherein said second magnetic field generating means comprises a first magnetic pole extending transversely of said desired direction from side-to-side of said developer blanket, and wherein said first magnetic field generating means comprises second magnetic pole segments spaced apart from each other, said second magnetic pole segments extending substantially in a first row transversely of said desired direction from side-to-side of said developer blanket.

25. A process for mixing magnetizable developer material for use in developing images on an image recording surface, said process comprising the steps of:

providing an imaging surface arranged for movement in a desired direction;

transporting a blanket of said developer material in a given direction; and mixing said developer material, the improvement wherein, said mixing step comprises;

magnetically dividing said blanket of developer material into a plurality of adjacent streams of developer material arranged one next to the other in a direction transverse to said desired direction of movement of said imaging surface and extending from side-to-side of said imaging surface; and magnetically controlling the trajectory of said streams of developer material so that the trajectory followed by one stream is different from the trajectory followed by another of said streams;

said magnetic dividing and trajectory controlling step including the steps of: generating a first substantially nonuniform magnetic field acting on said developer blanket and extending transversely of said desired direction; and generating a second substantially uniform magnetic field acting on said developer blanket prior to said non-uniform magnetic field and extending transversely of said desired direction.

26. A process as in claim 25, wherein said step of magnetically controlling the trajectory of said streams comprises controlling the trajectory of said streams so that the trajectory followed by one stream is different from the trajectory followed by a stream next adjacent to said one stream.

27. A process as in Claim 25, further including the steps of forming an electrostatic image on said image recording surface, developing said electrostatic image with said developer material, and transferring said developed image to a sheet of final support material, and wherein said mixing step is included in said development step.

28. A process as in claim 25, further including the steps of:

cross-mixing said one stream of developer material; and cross-mixing said another of said streams of developer material independently of said cross-mixing of said one stream.

29. A process for mixing a magnetizable developer material for use in developing images on an image recording surface, said process including the steps of supporting a blanket of developer material for movement in a desired direction and mixing said developer material, the improvement wherein, said mixing step comprises:

magnetically dividing said blanket of developer materila into a plurality of streams of developer material which are widely spaced apart from each other transversely of said desired direction, said magnetic dividing step including generating a first substantially uniform magnetic field acting on said developer blanket and extending transversely of said desired direction and generating a second substantially non-uniform magnetic field acting on said developer blanket following said first magnetic field and extending transversely of said desired direction.

30. A process as in claim 29, further including the steps of forming an electrostatic image on said image recording surface, developing said electrostatic image with said developer material, and transferring said developed image to a sheet of final support material, said mixing step is included in said developing step.

* * * * *